US005876252A

United States Patent [19]

Hahn et al.

[11] Patent Number: 5,876,252

[45] Date of Patent: Mar. 2, 1999

[54] CONNECTOR MOUNTING MECHANISM

[75] Inventors: Joachim Alfred Hahn, Schmitten; Dietrich Wilhelm Kümpel, Rüsselsheim; Patrik Müller, Frankenthal; Udo Alfred Pech, Lützelbach; Jörg Thomas, Dietzenbach, all of Germany

[73] Assignee: The Whitaker Corporation, Wilmington, Del.

[21] Appl. No.: 676,741

[22] Filed: Jun. 18, 1996

[30] Foreign Application Priority Data

Jun. 22, 1995 [GB] United Kingdom ..... 9512785

[51] Int. Cl.[6] ..... H01R 13/502

[52] U.S. Cl. ..... 439/701; 439/717

[58] Field of Search ..... 439/701, 717, 439/709, 712

[56] References Cited

U.S. PATENT DOCUMENTS 4,046,452 9/1977 Cassarly ..... 439/701

4,469,393 9/1984 Chewning, Jr. et al. ..... 439/717

4,797,123 1/1989 Weber ..... 439/717

*Primary Examiner*—Khiem Nguyen

*Assistant Examiner*—Yong Ki Kim

[57] ABSTRACT

A connector assembly comprises a mounting portion for mounting the connector to a complementary portion which could be either another connector or a member fixed to a structure such as an automobile's bodywork. The mounting portions comprise interengaging T-shaped walls and T-shaped profiles that are longitudinally slidably interengaged. The mounting portion walls comprise interleaving recesses and extensions and that enable the mounting portions to be interengaged by placing the mounting portions one against each other and then sliding them in opposing directions by only a short travel. The latter enables longitudinally slidable T-profiles to be used but nevertheless over short travel which is advantageous for certain applications to reduce cable length surplus.

8 Claims, 7 Drawing Sheets

CONNECTOR MOUNTING MECHANISM

BACKGROUND OF THE INVENTION

1. Field of the Invention

This invention relates to a mechanism for mounting a connector assembly to a structure such as a panel, or to another connector assembly.

2. Description of the Prior Art

In many applications there is a need to fix a connector assembly to a structure, one example being in an automobile. Harnesses for an automobile typically comprise a plurality of connectors interconnected by cables, the connectors being fixed to body work or other structures of the automobile. Harnesses assembled to the automobile often require that the connectors have a determined position and do not rattle or move about with respect to the automotive structure.

It is desirable to have a means of fixing the connector assemblies to the structure that allows rapid mounting, but that is sturdy enough to allow mating of connectors (which sometimes generate quite high forces). Many resilient latching systems do not satisfy this requirement for robustness. It is also desirable to have a mounting mechanism that requires very little or no extra length in the wires that is sometimes needed for mounting of the connector to the mounting structure. Cost effectiveness, robustness, reliability, and short cable surplus length are therefore desirable features of the connector mounting mechanism.

SUMMARY OF THE INVENTION

An object of this invention is to provide a mounting mechanism for a connector assembly that allows rapid and easy mounting, in a robust and reliable manner.

It is an object of this invention to provide a connector mounting mechanism that requires little additional cable length to enable mounting of the connector to a structure.

DETAILED DESCRIPTION OF THE PREFERRED EMBODIMENT

Figure 1:
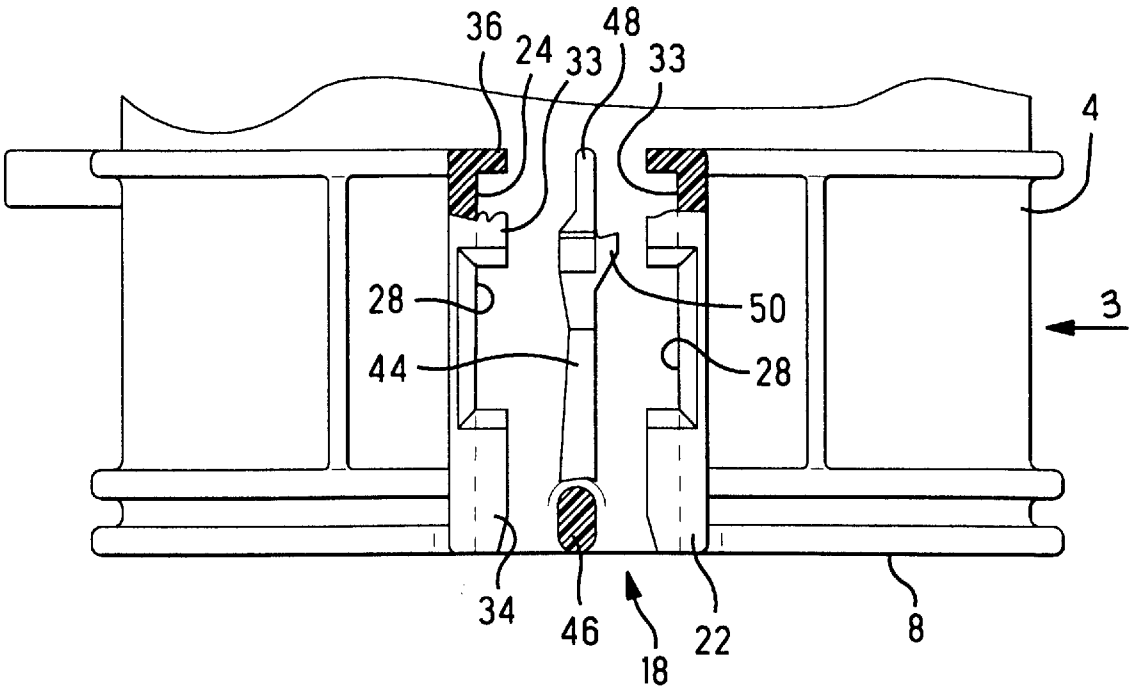
FIG. 1 is a side view of part of a connector assembly showing a connector mounting mechanism according to this invention.

Referring first to FIGS. 1–4, an electrical connector assembly comprises an insulative housing 4 and a plurality of terminal receiving cavities 6 extending therethrough for receiving electrical terminals connected to conducting cables to form a harness. The connector assembly housing 4 extends between a terminal receiving end 8 to a mating end 10, the terminals being inserted into the cavities 6 from the terminal receiving end 8 and the mating end 10 mates with a complementary connector for connection thereto. The cavities 6 are surrounded by an outer wall 12 that comprises opposing side walls 14,16. The connector extends along a longitudinal axis 17.

The connector housing further comprises a mounting mechanism having a mounting portion 18 extending from an along the first side wall 14, and a complementary mounting portion 20 extending from and along the second side wall 16. The mounting portion 18 comprises opposing U-shaped longitudinally extending walls 22 that form a T-shaped groove 24 for receiving a complementary T-shaped profile 26 constituted by the complementary mounting portion 20. A plurality of the housings 4 can therefore be stacked together. The walls 22 have recesses 28 along a certain longitudinal length of a central portion for receiving outward extensions 30 of the T-shaped profile 26 therethrough. The T-shaped profile 26 also has a recess 32 along a central longitudinal portion for receiving entry portions 34 of the walls 22 therepast.

Figure 5:
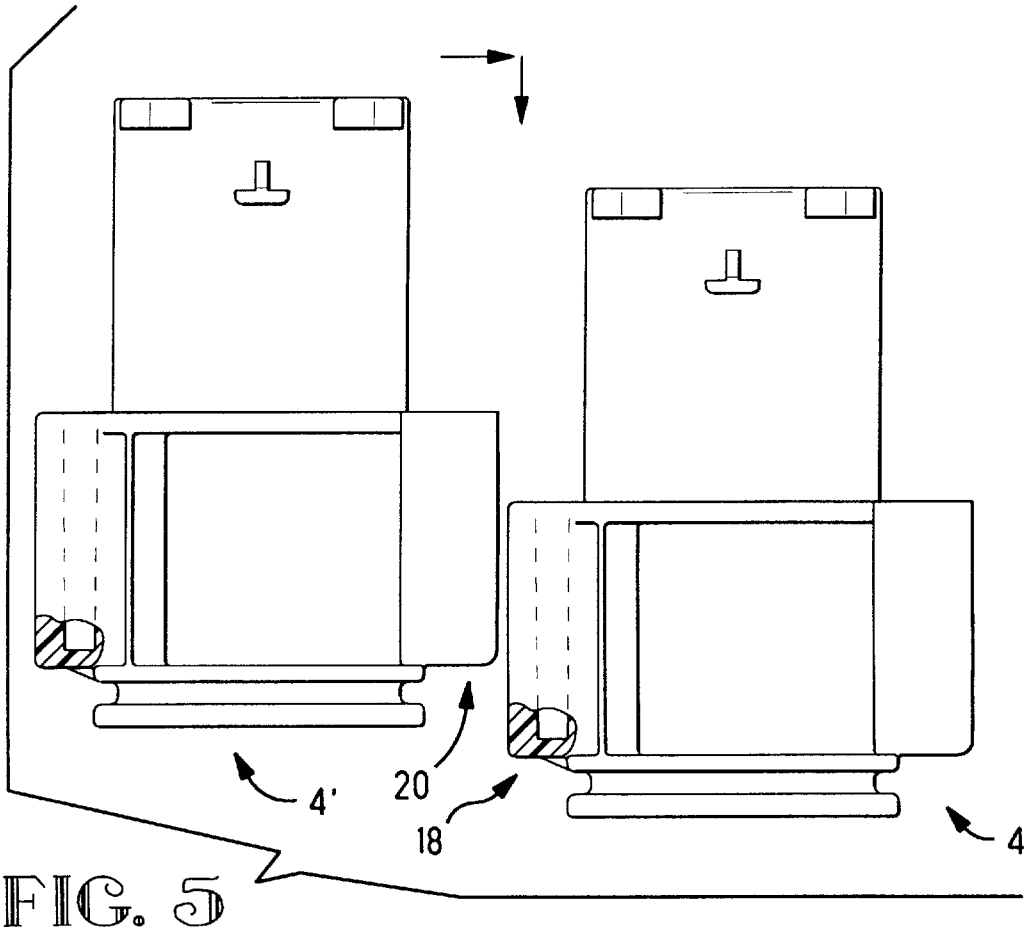
FIG. 5 is an end view of two connector assemblies about to be mounted together.
Figure 6:
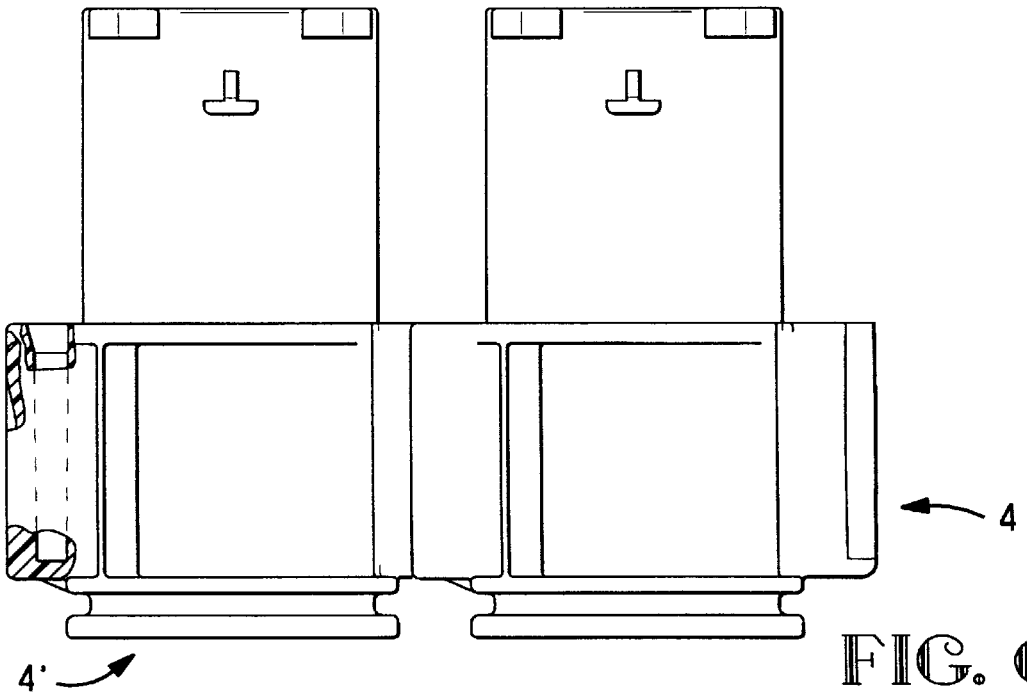
FIG. 6 is a similar view to FIG. 5 but of the connector assemblies mounted together.
Figure 7:
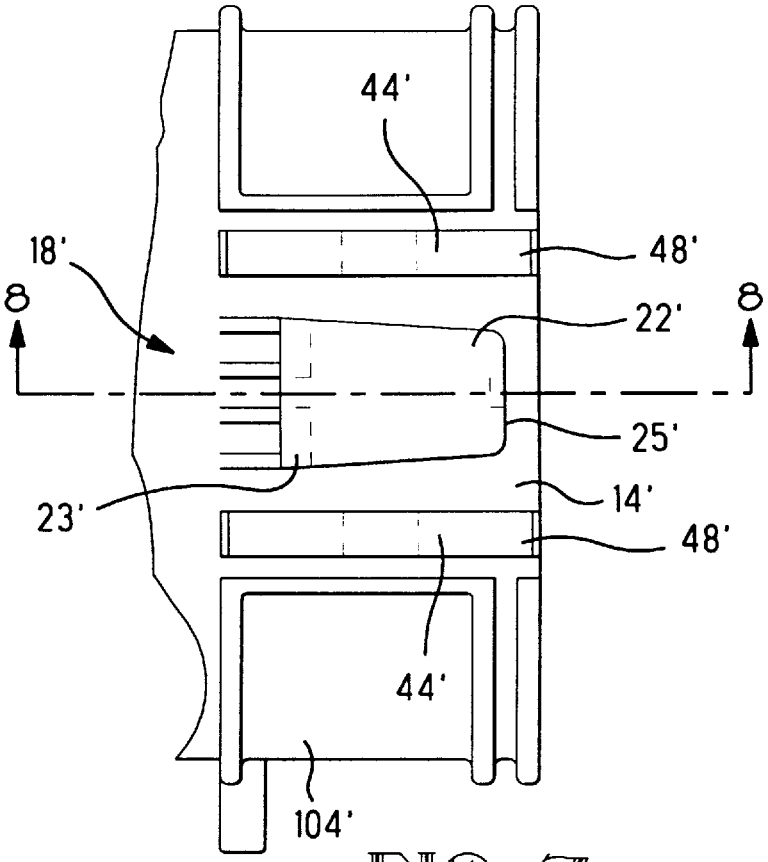
FIG. 7 is a partial side view of another connector embodiment according to this invention.
Figure 8:
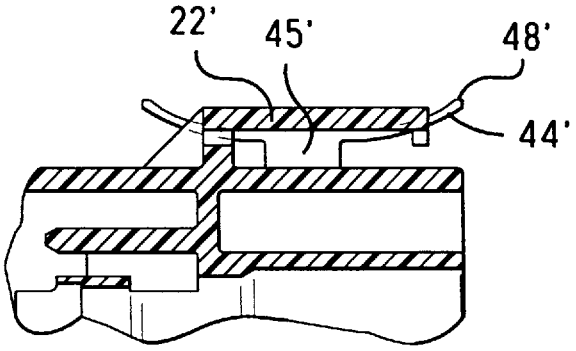
FIG. 8 is a cross-sectional view through lines 8—8 of FIG. 7.
Figure 9:
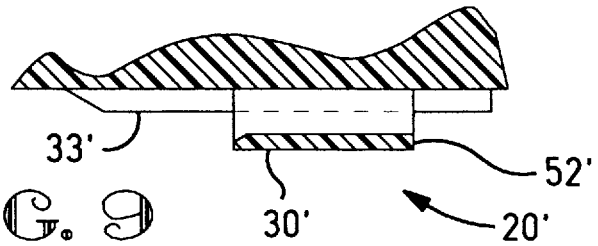
FIG. 9 is a partial cross-sectional view of a complementary mounting mechanism for mounting of the connector of FIG. 8.
Figure 10:
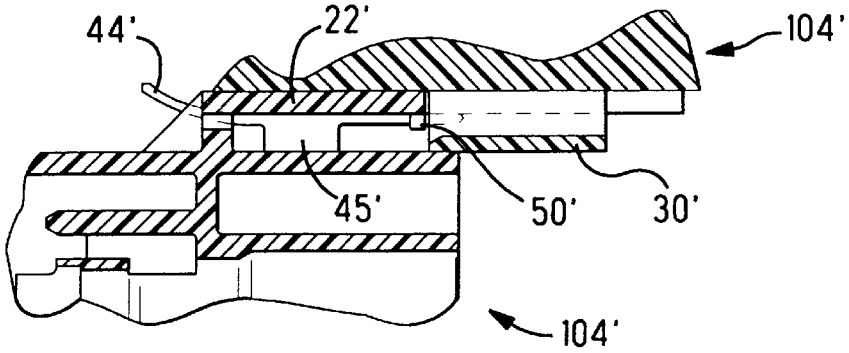
FIGS. 10–13 are cross-sectional views shown various adjures in mounting of the connector assembly of FIG. 7 to the complementary mounting mechanism of FIG. 9.
Figure 11:
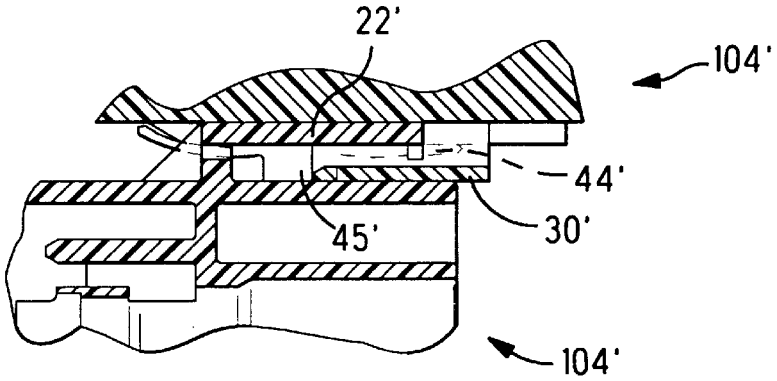
Figure 12:
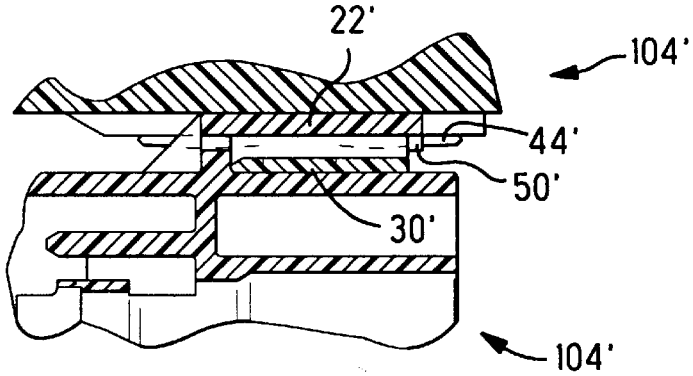

As can be seen in FIGS. 5 and 6, two connector housings can be mounted together by interengagement of the recess and extension 30,32 (FIG. 2) respectively of the complementary portion 20, with the extension and recess 34,28 (FIG. 1) respectively of the mounting portion 18. The latter is effected by moving the connectors 4,4' together in the direction of arrow Y. Subsequently, the connectors are slidably moved in opposing longitudinal directions (direction Z) such that the extensions 30,31 engage below the extensions 33,34 for securely holding the mounting portions 18,20 together in the stacked arrangement shown in FIG. 6.

An end wall 36 (FIG. 1) projects into the T-shaped groove 24 and acts as a stop that abuts an end 38 (FIG. 2) of the complementary mounting portion.

Figure 2:
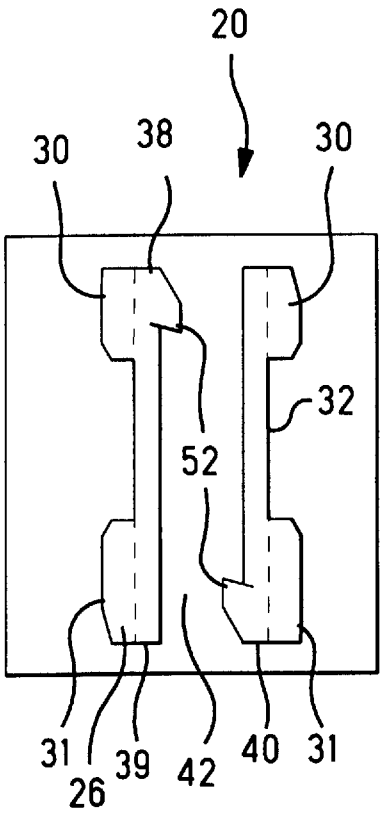
FIG. 2 is a side view of a complementary mounting mechanism to which the mounting mechanism of FIG. 1 is mountable.
Figure 3:
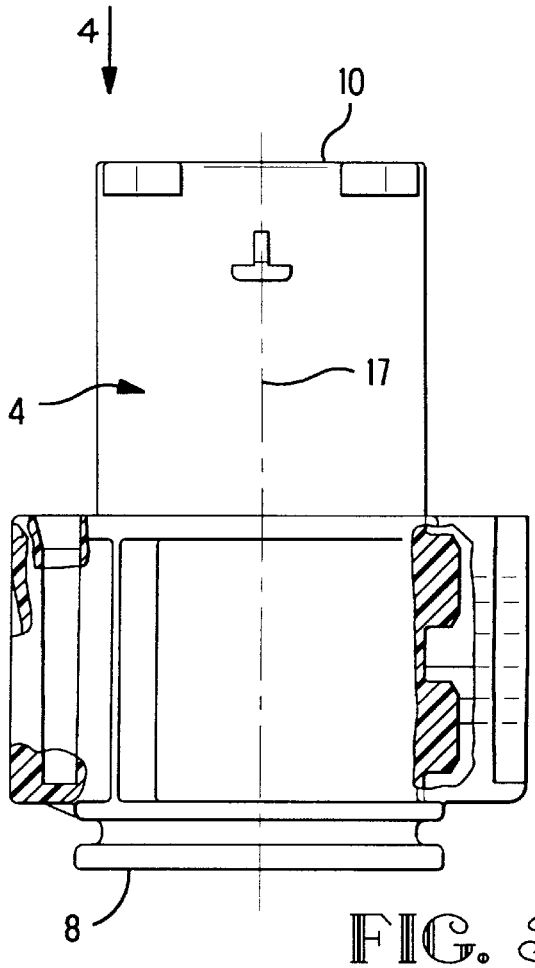
FIG. 3 is a partial cross-sectional end view in the direction of arrow 3 of FIG. 1.
Figure 4:
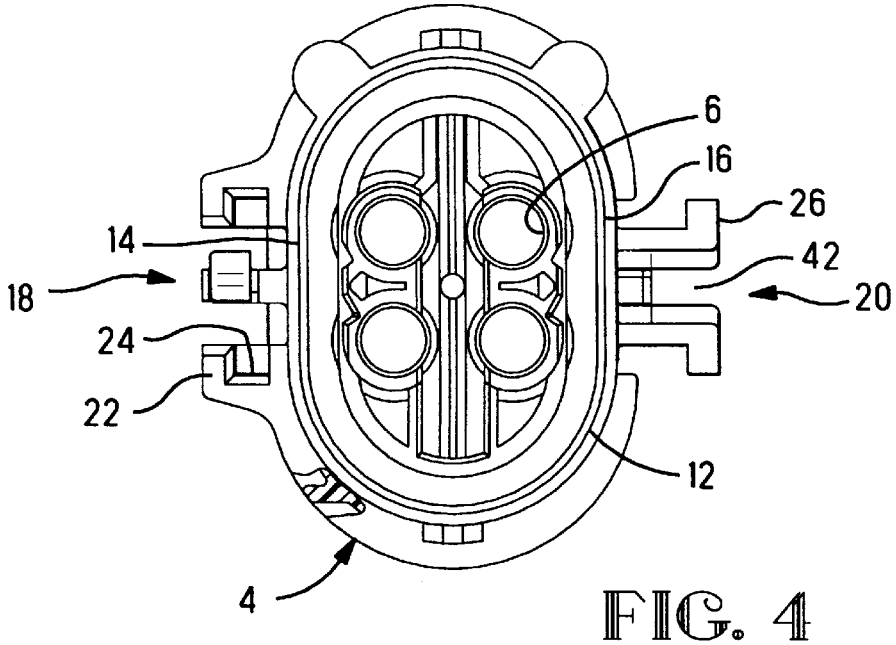
FIG. 4 is a view in the direction of arrow 4 of FIG. 3.

Referring to FIGS. 1, 2 and 4, the complementary T-shaped profile 26 is comprised of two walls 39,40 separated by a longitudinally extending gap 42. When connectors are stacked together, the gap 42 which receives a cantilever beam latching arm 44 pivotly mounted at a pivot end 46 to the mounting portion 18. Proximate a free end 48 of the arm 44, is a latch member 50 that is for engagement with a complementary latching shoulder 52 extending from either wall 39,40 of the complementary portion 20. Protrusions 52 are provided diametrically opposite each other on both walls 39,40 to allow orientation of the mounting portion 18 with respect to the complementary portion 20 from opposing directions. Connectors can thus be stacked together with opposed orientations.

The advantage of the interengaging extensions and recesses of the mounting portions is that only a relatively small longitudinal movement between mounting portions is required thereby enabling, in certain applications, shorter surplus cable length that is provided to enable the stacking together of connectors. The provision of the stop 36 that is situated towards the mating end 10 of the connector ensures that when coupling a mating connector to the connector 4, the mating forces are transmitted through to the complementary mounting portion 20 via the stops 36 rather than via the latching arm 44, providing a robust solution.

Referring now to FIGS. 7–13, another connector assembly embodiment is shown comprising a housing 104', and a mounting portion 18' for mounting to a complementary mounting portion 20'. The mounting portion 18' comprises a tongue 22' extending substantially parallel to the connector side wall 14' and attached at one end 23' thereto. The wall 22' is spaced apart from the side wall 14' to receive a complementary wall 30' of the complementary portion 20' therebehind for secure mounting of the portions 18',20' together. Flanking either side of wall 22' are longitudinally extending spring members 44' that extend from a central attachment portion 45' to free ends 48' that are resiliently received against a complementary surface 33' of the complementary portion 20'.

Figure 13:
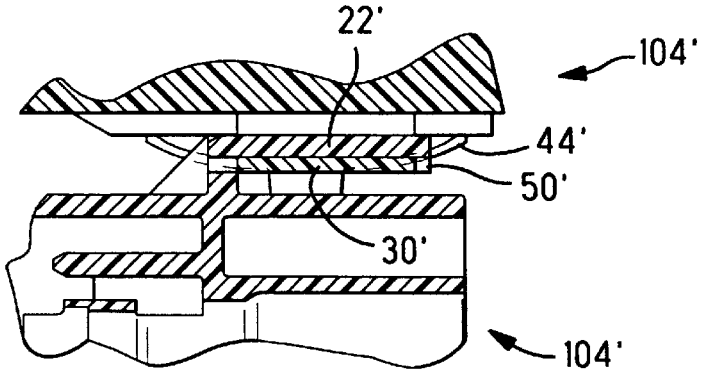
Figure 15:
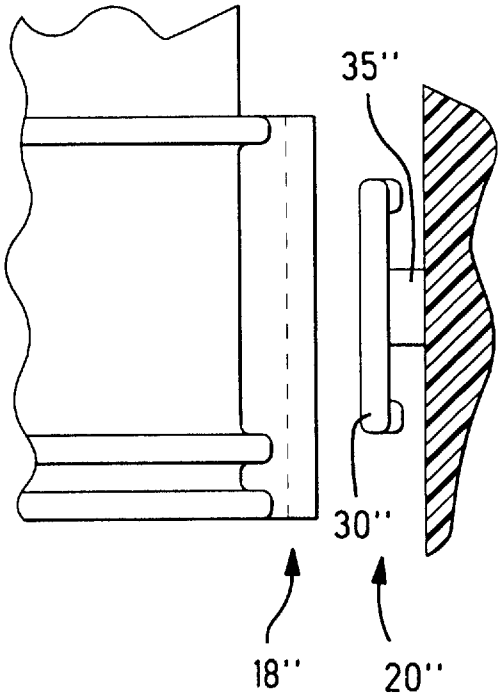
FIG. 15 is a view in the direction of arrow 15 of FIG. 4.
Figure 14:
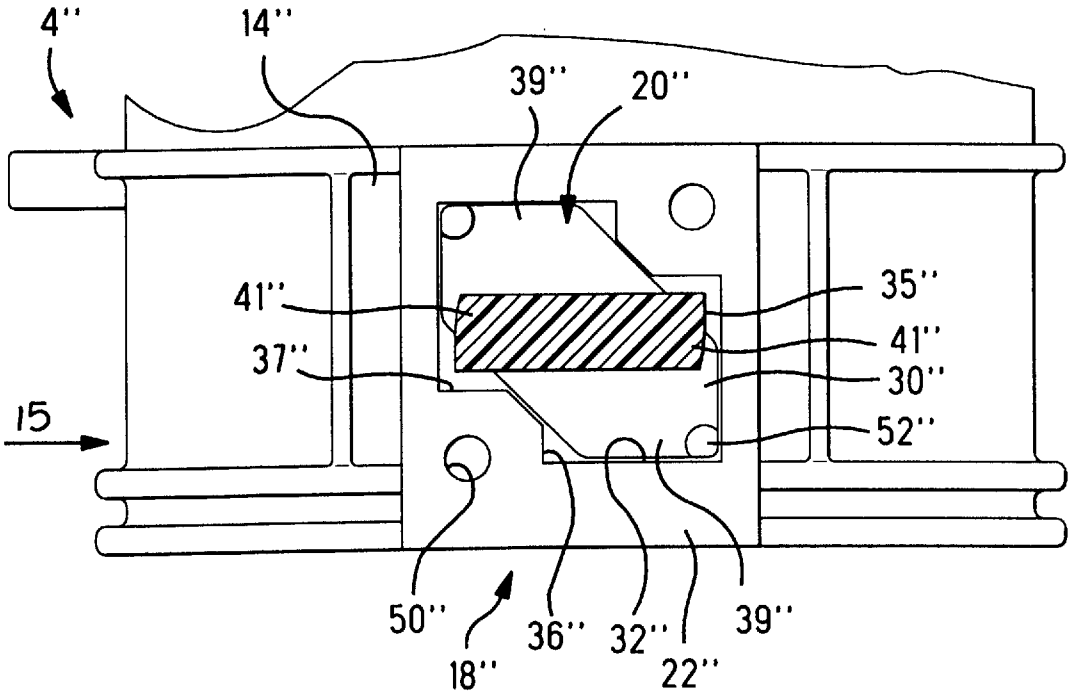
FIG. 14 is a side view of a third embodiment with a complementary mounting mechanism partially mounted to the connector assembly.
Figure 16:
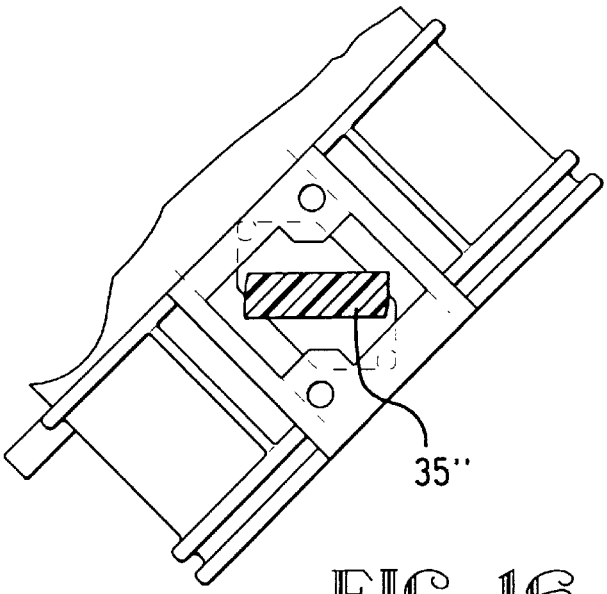
FIG. 16 is a view similar to FIG. 14 but in a partially coupled position.

At a free end 25' of the tongue wall 22' is a protrusion 50' extending towards the side wall 14' of the connector housing for locking of the mounting portions together in the longitudinal direction by engagement of the protrusion 50' with an end 32' of the complementary portion 20' (see FIG. 13). The spring members 44' bias the mounting portions 18',20' apart from each other to ensure that the walls 22',30' are biased against each other and the protrusion 50' engaged against the end 52'of the wall 30'. The advantage of the above embodiment is very rapid, reliable and robust mounting of the connector to a complementary mounting portion, as well as rapid disassembly thereof which in certain applications reduces handling costs.

Figure 17:
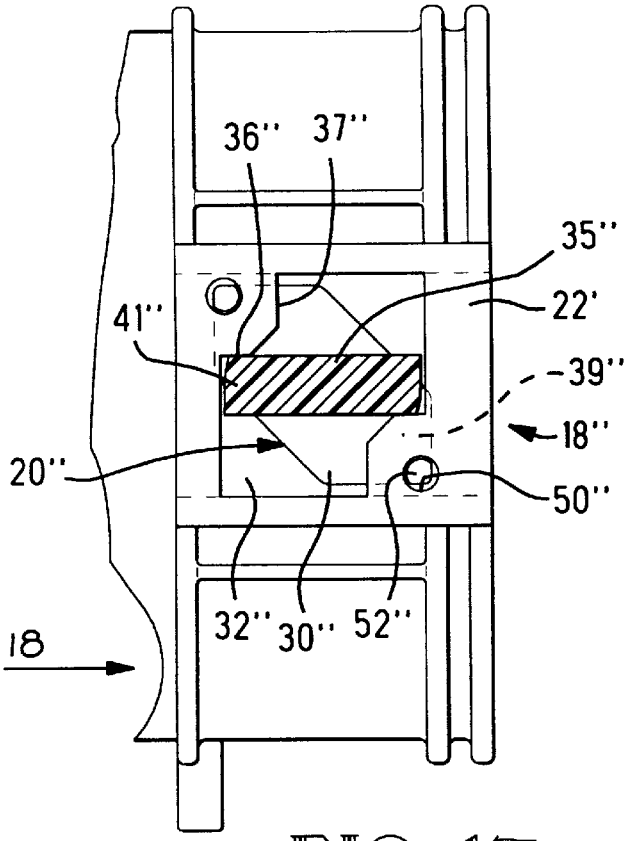
FIG. 17 is a view similar to that of FIG. 14 but in a fully coupled position.
Figure 18:
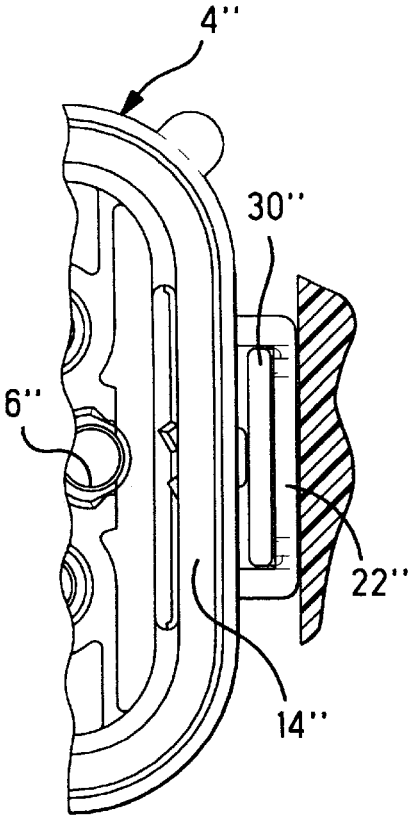
FIG. 18 is a view in the direction of arrow 18 of FIG. 17.

Referring now to FIGS. 14–18, another embodiment of a connector assembly comprising a housing of 4" is shown with terminal receiving cavities 6". A first mounting portion 18" comprises a wall 22" spaced apart but substantially parallel to a side wall 14" of the connector housing. The wall 22" comprises a diagonally extending cutout 32" for receiving a complementarily shaped wall 30" of a complementary second mounting portion 20" therethrough. The plate-like diamond shaped complementary wall 30" is attached to the complementary mounting portion 20" via a wide leg portion 35". The leg portion 35" has an oblong shape that has ends 41" that overlap stop edges 36",37" of the first mounting portion 18". The edges act as stops to limit rotation of the first mounting portion 18" with respect to the complementary mounting portion 20" over a certain angle range—in this case 90°. Upon rotation of the portion 20" with respect to the portion 18", opposing diagonal ends 39" engage beneath the wall 22" thereby locking the connector 4 to the complementary mounting portion 20". Protrusions 52" at the diagonal ends 39" engaging complementary recesses 50" of the wall 22" for latching the mounting portions in the locked position as shown in FIG. 17. Rapid and simple assembly of the mounting portions can thus be achieved, but nevertheless providing a very robust mounting connection that also allows easy unmounting. The pivot interengagement of the mounting portions also reduces the need for cable surplus length.

The complementary mounting portions of the above embodiments may either be on another connector such that mounting of a plurality of connectors can be made in "daisy chain", or an attachment fixed to a structure such as an automobile's bodywork.

We claim:

1. A connector stackable to a second similar connector, the connector comprising a housing having terminal receiving cavities extending in a longitudinal direction therethrough, the housing having a first mounting portion extending along a first side wall of the housing and a second mounting portion extending along a second side wall of the housing, the first and second mounting portions being complementary such that a plurality of connectors are stackable together, the first mounting portion comprising opposed longitudinally extending walls that form a T-shaped groove for slidably receiving a complementary T-shaped profile of the second mounting portion of the second connector or of a support structure, characterized in that in the longitudinal direction, the longitudinally extending walls have recesses along their length for receiving extensions of the complementary T-shaped profile therethrough transversely to the longitudinal direction into alignment with the T-shaped groove such that the complementary T-shaped profile can be subsequently slid in the longitudinal direction to secure the connectors together.

2. The connector of claim 1 wherein a latching arm is provided between the longitudinally extending walls of the first mounting portion.

3. The connector of claim 2 wherein the latching arm is pivotally mounted at one end to the connector first side wall.

4. The connector of claim 1 wherein the T-shaped profile of the second mounting portion is formed by a pair of longitudinally extending walls attached to the second side wall.

5. The connector of claim 4 wherein the walls are separated by a gap for receiving a latch arm of the second connector therebetween.

6. The connector of claim 5 wherein the walls have latching shoulder extensions disposed at diagonally opposed ends to enable latching of the stacked connectors in the same or opposed orientations.

7. The connector of claim 1 wherein the T-shaped groove of the first mounting portion is provided with a stop at one longitudinal end disposed towards a mating side of the connector, such that mating forces are transmitted through the stop to the complementary mounting portion of the support structure or second connector.

8. A connector stackable to a second similar connector, the connector comprising a housing having terminal receiving cavities extending in a longitudinal direction therethrough, the housing having a first mounting portion extending along a first side wall of the housing and a second mounting portion extending along a second side wall of the housing, the first and second mounting portions being complementary such that a plurality of connectors are stackable together, the first mounting portion comprising a locking wall spaced apart from the first side wall and having a cutout for receiving a complementary locking wall of the second mounting portion of the second connector therethrough transverse to the longitudinal direction, the cutout and complementary locking wall shaped in a manner as to initially enable mounting the first and second connectors at an angle with respect to each other, the connectors being subsequently rotatable such that the complementary locking wall engages behind the locking wall for locking the stacked connectors together, wherein the locking wall cutout extends diagonally, and the complementary locking wall has a complementary diamond shape receivable therethrough and rotatable such that opposing diagonal ends of the complementary locking wall engage behind the locking wall.

* * * * *